US012102243B2

(12) United States Patent
Mertzel

(10) Patent No.: US 12,102,243 B2
(45) Date of Patent: Oct. 1, 2024

(54) UTENSIL FOR MOUNTING ON A CONTAINER AND FOLDING FOR MINIMIZING STORAGE SPACE OF THE CONTAINER AND UTENSIL COMBINATION

(71) Applicant: Kitchen Concepts Unlimited LLC, Northridge, CA (US)

(72) Inventor: Joelle Mertzel, Porter Ranch, CA (US)

(73) Assignee: Kitchen Concepts Unlimited LLC, Northridge (CA)

( * ) Notice: Subject to any disclaimer, the term of this patent is extended or adjusted under 35 U.S.C. 154(b) by 0 days.

(21) Appl. No.: 18/138,102

(22) Filed: Apr. 23, 2023

(65) Prior Publication Data

US 2023/0380615 A1 Nov. 30, 2023

Related U.S. Application Data

(63) Continuation of application No. 16/901,928, filed on Jun. 15, 2020, now Pat. No. 11,771,251.

(51) Int. Cl.

| | |
|---|---|
| ***A47G 21/02*** | (2006.01) |
| *A47G 21/00* | (2006.01) |
| *A47G 21/04* | (2006.01) |

(52) U.S. Cl.

CPC ..... *A47G 21/02* (2013.01); *A47G 2021/002* (2013.01); *A47G 21/005* (2013.01); *A47G 21/023* (2013.01); *A47G 21/04* (2013.01)

(58) Field of Classification Search

CPC .... A47G 21/02; A47G 21/005; A47G 21/023; A47G 21/04; A47G 2021/002; B25G 3/38; B65D 51/246; B65D 77/245

See application file for complete search history.

(56) References Cited

U.S. PATENT DOCUMENTS

| | | | | | |
|---|---|---|---|---|---|
| 490,430 | A | * | 1/1893 | Feicker | A47G 21/023 30/323 |
| 854,745 | A | * | 5/1907 | King | A47G 21/02 30/150 |
| 2,291,981 | A | * | 8/1942 | Neururer | A47G 21/04 30/324 |
| 2,487,166 | A | * | 11/1949 | Miller | A47G 21/023 30/323 |
| 2,516,618 | A | * | 7/1950 | Crowl | A47G 21/06 30/151 |
| 2,600,013 | A | * | 6/1952 | Malone | A47G 21/02 30/322 |

(Continued)

*Primary Examiner* — Don M Anderson

(74) *Attorney, Agent, or Firm* — Andrus Intellectual Property Law, LLP

(57) ABSTRACT

A food product spreader apparatus including a blade having a longitudinal axis, a handle having a longitudinal axis and a pivot block to which the blade is secured. The blade includes a mounting portion for storing the spreader on a food container. The pivot block is rotatably mounted to the handle and the blade and pivot block are movable between a first position where the longitudinal axes of the blade and the handle are generally parallel to one another and a second position where the longitudinal axes of the blade and the handle are generally perpendicular to each other. In the first position the spreader apparatus is available for use and in the second position the spreader apparatus is able to be stored on the container while occupying a minimal amount of space.

18 Claims, 11 Drawing Sheets

(56) References Cited

U.S. PATENT DOCUMENTS 2,682,705 A * 7/1954 Johnson ..... A47G 21/04 403/112
4,060,176 A * 11/1977 Tobiasson ..... B65D 51/246 206/217
4,589,204 A * 5/1986 Vogel ..... A47G 21/02 30/340
4,615,120 A * 10/1986 Newman ..... A47G 21/02 30/143
5,419,049 A * 5/1995 MacArthur-Onslow ..... A47G 21/02 229/401
5,630,276 A * 5/1997 Weinstein ..... A47G 21/02 30/324
5,669,143 A * 9/1997 Wu ..... A47G 21/02 30/322
5,735,050 A * 4/1998 Hsieh ..... A47G 21/04 30/322
5,890,223 A * 4/1999 Klemmer ..... A47G 21/02 30/326
5,940,974 A * 8/1999 Lee ..... A47G 21/02 30/322
6,116,450 A * 9/2000 Huang ..... B65D 51/246 215/DIG. 5
6,199,285 B1 * 3/2001 Sheehan ..... A47G 21/02 16/436
6,688,469 B1 * 2/2004 Barnes ..... B65D 77/245 206/217
6,751,873 B2 * 6/2004 Mattson ..... A47G 21/02 30/322
7,237,463 B1 * 7/2007 Lee ..... B25G 3/38 81/177.8
8,066,148 B2 * 11/2011 Garahan ..... A45F 5/02 220/737
9,560,925 B2 * 2/2017 Harris ..... G01C 17/02
10,758,070 B1 * 9/2020 Infante ..... A47G 21/06
11,083,315 B2 * 8/2021 Park ..... A47G 21/02
11,219,995 B1 * 1/2022 Meadows ..... B25G 1/04
D945,182 S * 3/2022 Schüle ..... D6/542
11,771,251 B2 * 10/2023 Mertzel ..... A47G 21/02 81/489
2001/0002673 A1 * 6/2001 Huang ..... A47G 21/02 206/217
2002/0148057 A1 * 10/2002 Hobden ..... B25G 3/38 15/210.1
2003/0029044 A1 * 2/2003 Mattson ..... A47G 21/02 30/324
2004/0244131 A1 * 12/2004 Cassar ..... B25G 3/38 15/144.1
2006/0130336 A1 * 6/2006 Christensen ..... B26B 25/005 30/142
2007/0050987 A1 * 3/2007 Cervantes ..... A47G 21/08 30/150
2009/0144991 A1 * 6/2009 Synnestvedt ..... A47G 21/02 30/324
2009/0277902 A1 * 11/2009 Darflinger ..... B65D 51/246 220/212
2009/0289070 A1 * 11/2009 Costa ..... A47G 21/181 220/574.1
2011/0088266 A1 * 4/2011 Currie ..... A47G 21/08 30/324
2011/0203065 A1 * 8/2011 Cassar ..... B25G 3/24 15/144.2
2012/0067164 A1 * 3/2012 Su ..... B25G 3/38 74/575
2014/0332439 A1 * 11/2014 Glassman ..... A47G 21/02 206/553
2015/0128770 A1 * 5/2015 Liu ..... B25G 1/063 81/489
2015/0143703 A1 * 5/2015 Nair ..... A47G 21/02 30/147
2015/0330781 A1 * 11/2015 Harris ..... A47G 21/02 7/164
2016/0095455 A1 * 4/2016 Rastegar ..... A47G 21/02 30/123
2016/0311248 A1 * 10/2016 Ericsson ..... H05B 3/0038
2016/0316948 A1 * 11/2016 Marciano ..... A47G 21/02
2017/0100272 A1 * 4/2017 Pathak ..... B25J 11/0045
2017/0341243 A1 * 11/2017 Sheahan ..... B25F 1/006
2018/0058536 A1 * 3/2018 Pathak ..... A61B 5/4836
2018/0360246 A1 * 12/2018 Lefferts ..... A47G 21/02
2019/0210210 A1 * 7/2019 Liu ..... B25B 23/0007
2019/0365129 A1 * 12/2019 Pepper ..... B65D 43/163
2019/0381651 A1 * 12/2019 Miksovsky ..... A47G 21/02
2020/0140161 A1 * 5/2020 Poehls ..... B65D 77/245
2020/0383506 A1 * 12/2020 Rubenson ..... A47G 21/04
2021/0030177 A1 * 2/2021 Henry ..... A47G 21/04
2021/0059443 A1 * 3/2021 Jackson, III ..... A47G 21/02
2021/0085107 A1 * 3/2021 Sutton ..... A47G 21/02
2021/0127875 A1 * 5/2021 Cohen ..... A47G 21/04
2021/0321804 A1 * 10/2021 Oehlert ..... A47G 21/02
2021/0345802 A1 * 11/2021 Elvin-Jensen ..... A47G 21/18
2021/0386228 A1 * 12/2021 Mertzel ..... A47G 21/02
2022/0022674 A1 * 1/2022 Chuang ..... A47G 21/04

* cited by examiner

UTENSIL FOR MOUNTING ON A CONTAINER AND FOLDING FOR MINIMIZING STORAGE SPACE OF THE CONTAINER AND UTENSIL COMBINATION

PRIORITY CROSS-REFERENCE TO RELATED APPLICATION

This application is a continuation and claims priority pursuant to 35 U.S.C. 120 from U.S. patent application Ser. No. 16/901,928, entitled MOUNTABLE AND FOLDABLE UTENSIL WITH STRUCTURE FOR HINDERING AND LIMITING MOVEMENT OF UTENSIL COMPONENTS filed on Jun. 15, 2020, which Application is expressly incorporated herein by reference.

FIELD OF THE INVENTION

The present invention relates to a foldable utensil for mounting on a container and being stored therewith for minimizing storage space of the container and the utensil combination.

BACKGROUND OF THE INVENTION

Foldable eating utensils have long existed for camping and the like. A utensil has even existed having means for mounting the utensil on the rim of a food container. However, a mountable utensil having structures to allow easy reconfiguration between use and storage, all in a simple yet robust product that is reasonably priced, has escaped recognition and solution.

SUMMARY OF THE INVENTION

Briefly summarized, the present invention relates to a three component utensil including a first component for handling the utensil, the first component having a longitudinal axis, a second component connected to the first component, the second component having a utility portion, an inverted U-shaped mounting portion and a tab portion, the U-shaped mounting portion for mounting the utensil on a rim of a container wherein the container includes sidewalls, the second component having a longitudinal axis and being movable between a first position during use where the longitudinal axes of the first component and of the second component are generally parallel to each other and a second position during storage where the longitudinal axes of the first component and of the second component are generally perpendicular to each other when the utensil is mounted to the container rim and the utility portion extends over contents in the container and the first component extends along one of the sidewalls of the container, and a third component mounted to the first component for rotation about a horizontal axis, wherein the tab portion of the second component is mounted to the third component and rotates therewith for minimizing the space of the utensil and the container when the utensil and container are stored.

The present invention also includes a method for assembling a foldable utensil including the steps of providing a handle, providing a spreader blade having an inverted U shaped mounting portion for mounting the utensil on a rim of a container for storage of the utensil and the container, providing a pivot block, forming a first structure on the handle and a second structure on the pivot block to maintain relative movement between the spreader blade and the handle when the spreader blade is extended for use, securing the spreader blade to the pivot block, and rotatably connecting the pivot block to the handle for storing the utensil in a folded position on the container.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will become readily apparent to those skilled in the art. Any and all such modifications, variations, equivalents, and alternatives are intended to fall within the spirit and scope of the present invention.

Figure 1:
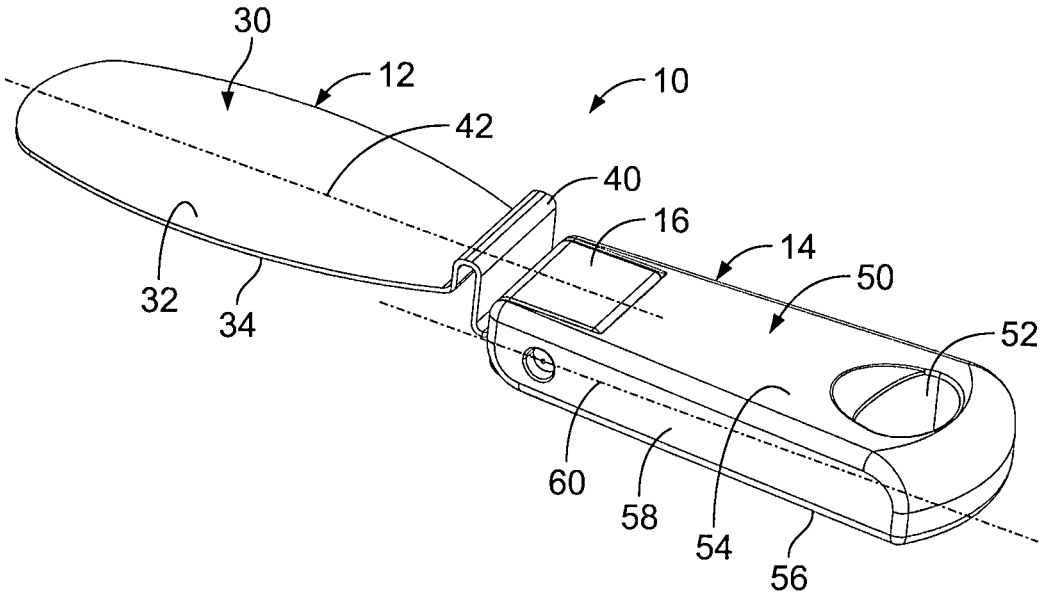
FIG. 1 is an isometric view of a foldable utensil embodiment in an extended for use configuration where longitudinal axes of a blade and a handle are aligned generally parallel to one another.
Figure 2:
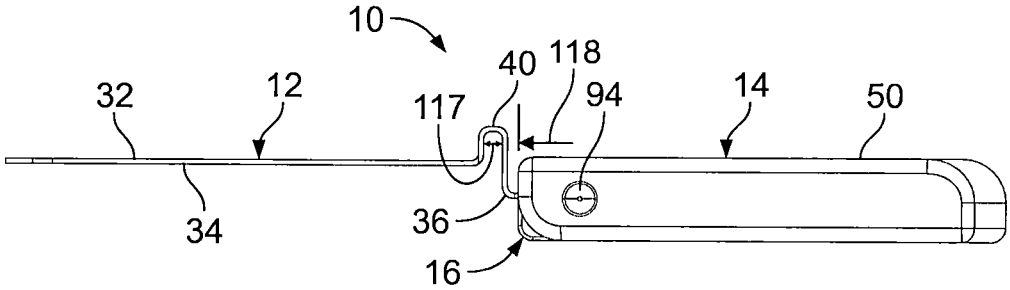
FIG. 2 is an elevation view of the foldable utensil shown in FIG. 1.
Figure 3:
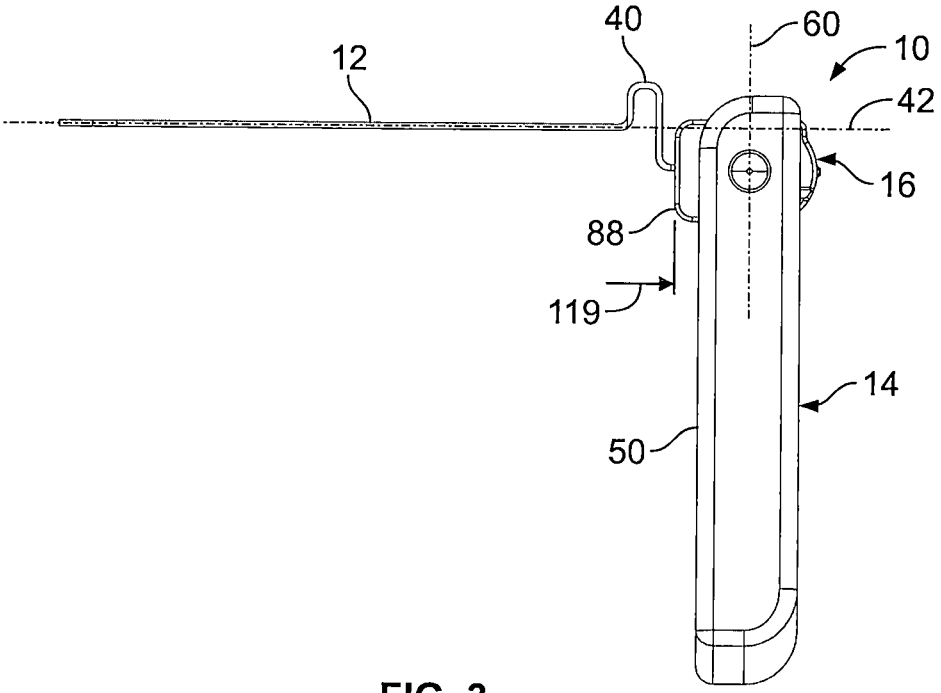
FIG. 3 is an elevation view of the foldable utensil shown in FIGS. 1 and 2, where the longitudinal axes of the blade and of the handle are aligned generally perpendicular to one another in a folded for storage configuration.
Figure 5:
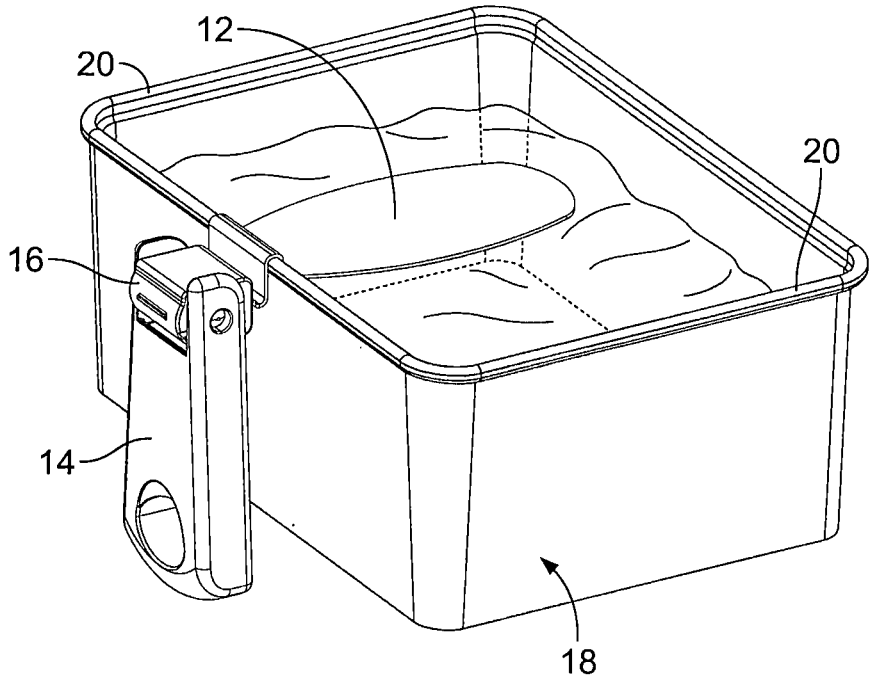
FIG. 5 is an isometric view of the foldable utensil shown in FIGS. 1-4, mounted to a margarine tub, the utensil being in the folded configuration.
Figure 6:
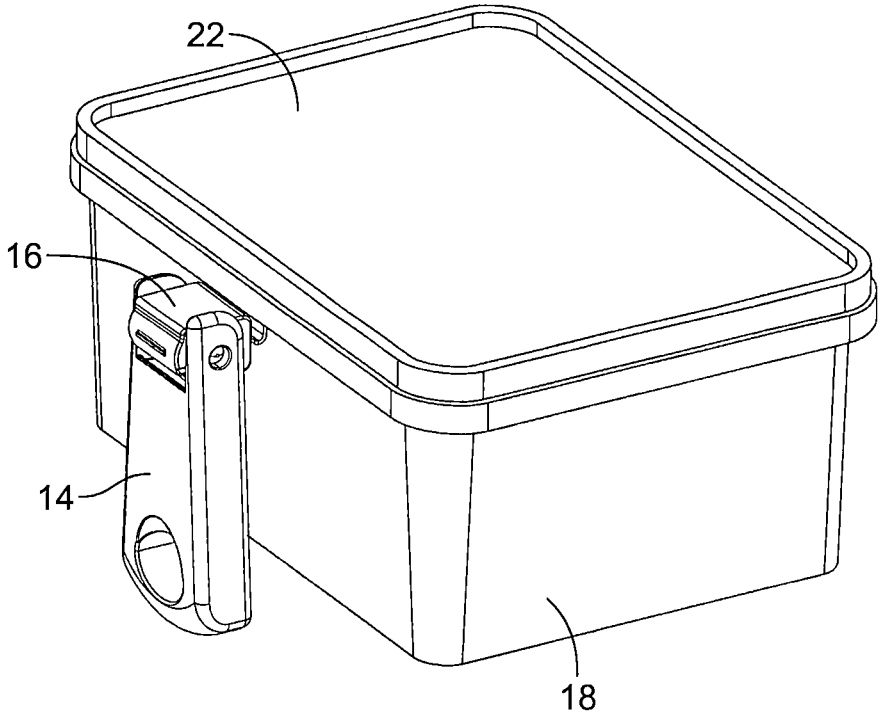
FIG. 6 is an isometric view similar to that shown in FIG. 5, but with a lid covering the tub and the blade of the foldable utensil.

An embodiment of the foldable utensil 10 is illustrated in FIGS. 1-4, and may take the form of a hand held food product spreader. The spreader utensil 10 includes a forward positioned instrument component having some utility, such as a spreader blade 12. ('Forward' is viewed to the left in FIGS. 1 and 2.) At the rear of the utensil may be a handle 14 component, and between the blade 12 and the handle 14 is a pivot block 16 component that rotatably connects the blade 12 to the handle 14. The spreader utensil 10 is particularly useful for transferring food products, such as butter, margarine or cream cheese, from a container or tub 18, FIGS. 5 and 6, to a slice of bread or a bagel, for example. A common experience is that the blade of a typical spreader becomes covered with the transferred food product and must be cleaned before the spreader can be put away in a kitchen drawer. As illustrated in FIGS. 3, 5 and 6, the present invention obviates the need for constantly cleaning the spreader utensil, as well as the need for the spreader to be put away separately from the food product container. The spreader utensil 10 may be mounted to a rim 20, FIG. 5, of the food container tub 18 and folded downward about 90° so as to stay with the tub while minimizing the space around the tub. Space saving is very advantageous when the tub is then stored in a refrigerator, on a table or on a shelf. In addition, the tub 18 may be covered with a lid 22, FIG. 6, with the spreader utensil 10 still mounted to the rim 20. The foldable feature enables the spreader 10 to occupy a minimal amount of space beyond the tub itself, a major advantage, and eliminates the need for cleaning the spreader, another advantage. The foldable feature also does away with the step of separately storing the spreader away from the tub, yet another advantage.

It is noted that the spreader utensil may have other uses, such as applying spackling paste to a wall or grout to tile, for example, and may have other instruments instead of the spreader blade for allowing other activities, such as those disclosed herein below.

Figure 4:
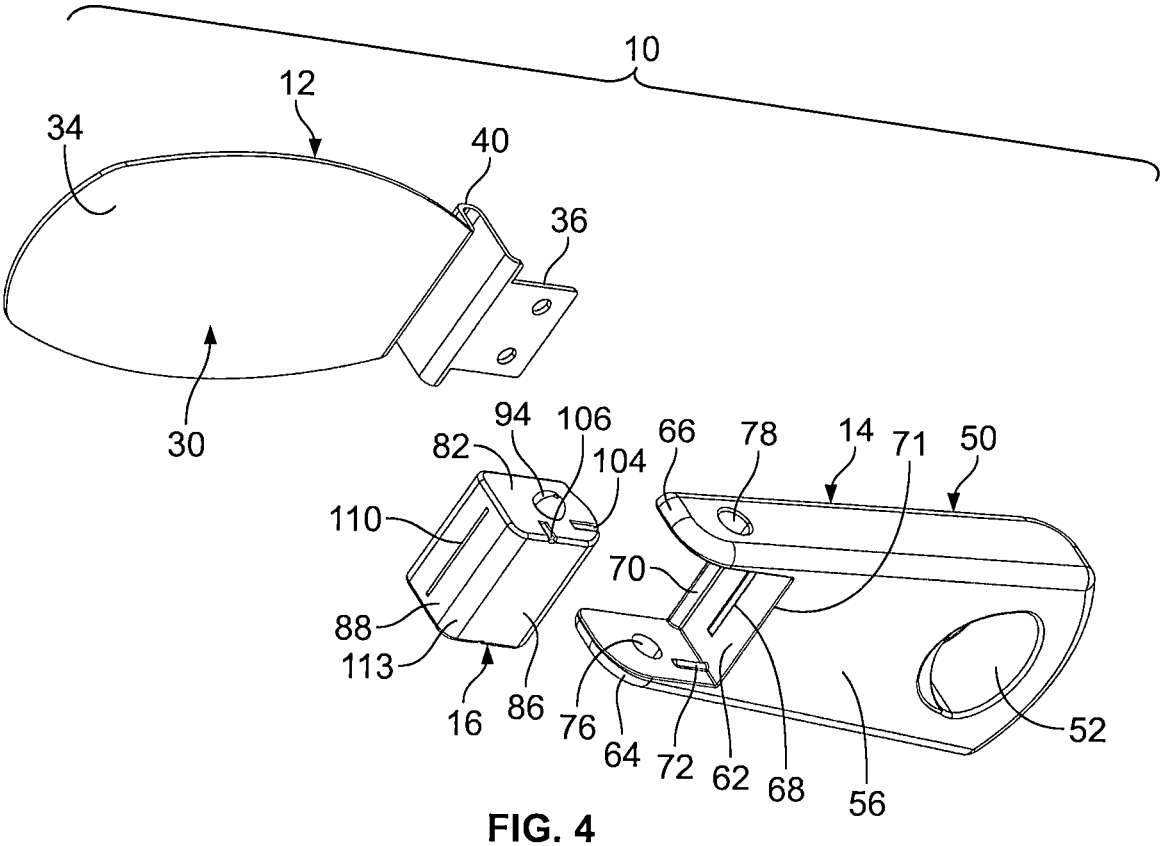
FIG. 4 is an exploded upward looking isometric view of the blade, a pivot block and the handle of the foldable utensil shown in FIGS. 1-3.
Figure 7:
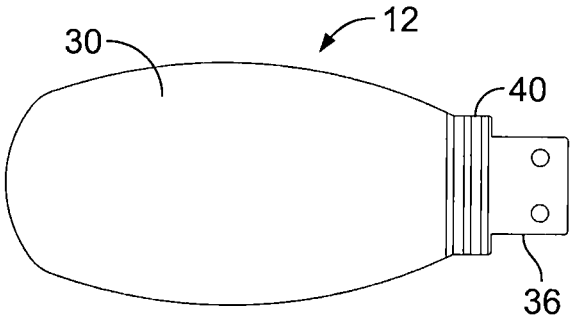
FIG. 7 is a plan view of the blade shown in FIGS. 1-4.
Figure 8:
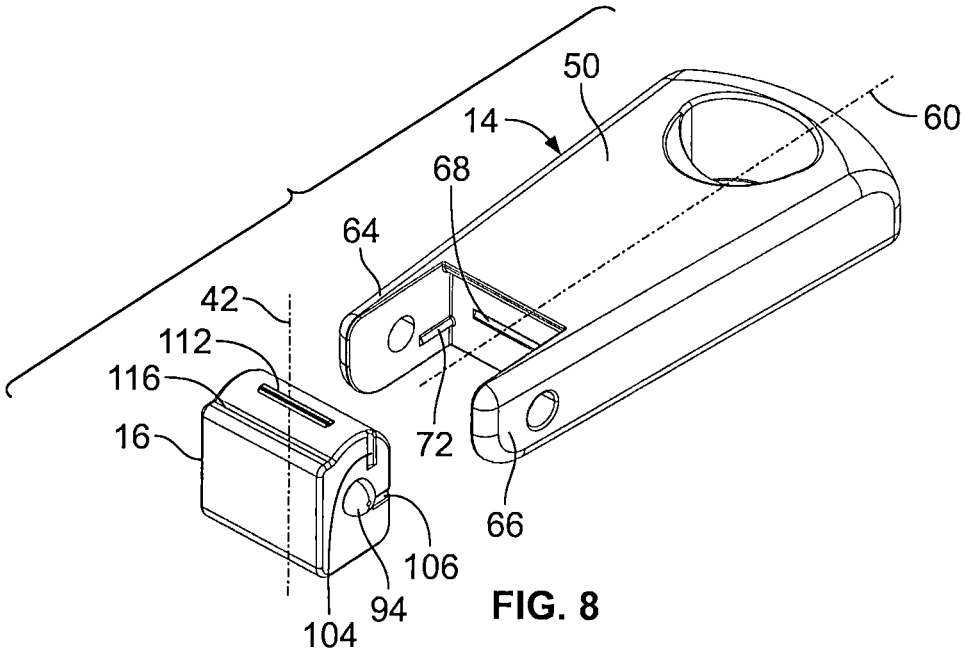
FIG. 8 is an exploded isometric view of the handle and the pivot block shown in FIG. 3.

The blade 12 of the spreader utensil 10 may have a forward spreader portion 30, FIGS. 1, 4 and 7, and a rearward located connector tab portion 36, FIGS. 4 and 7, that is attached to the pivot block 16 in any suitable manner, such as with an adhesive, screws, rivets, or nuts and bolts, so that the blade 12 is secured to and rotates with the pivot block 16. The spreader portion 30 may have a conventional shape, roughly elliptical, with an upper surface 32, FIG. 2, and a lower surface 34. Between the tab portion 36 and the spreader portion 30 of the blade 12 is a U-shaped looped or curved mounting portion 40 that accommodates the rim 20, FIG. 5, of the tub 18. The blade 12 has a longitudinal axis 42, FIG. 1.

In the alternative, the looped portion 40 of the spreader may be scaled up or down so as to be mountable on containers of different sizes and shapes.

Figure 9:
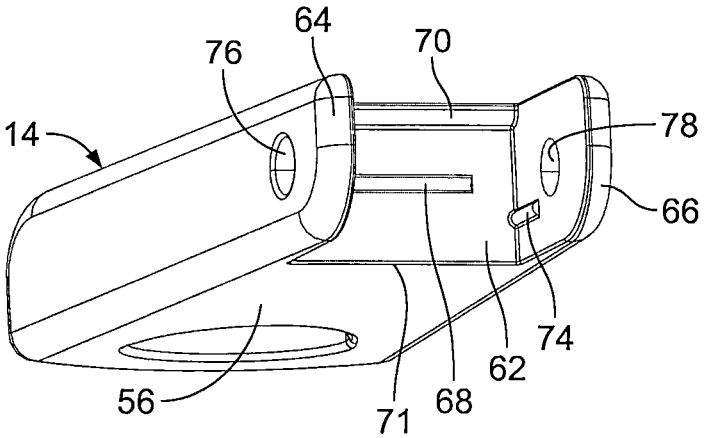
FIG. 9 is an isometric view of the front of the handle of the foldable utensil shown in FIGS. 1-4.
Figure 10:
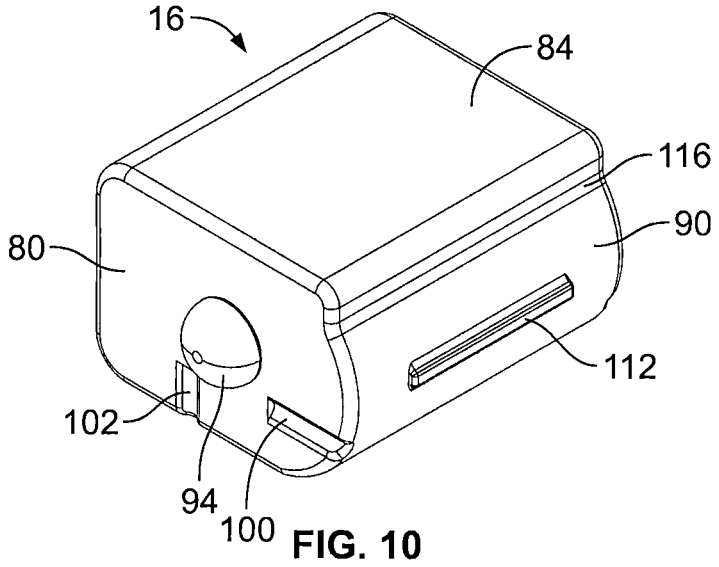
FIG. 10 is an enlarged isometric view of the pivot block of the foldable utensil shown in FIGS. 1-4.
Figure 11:
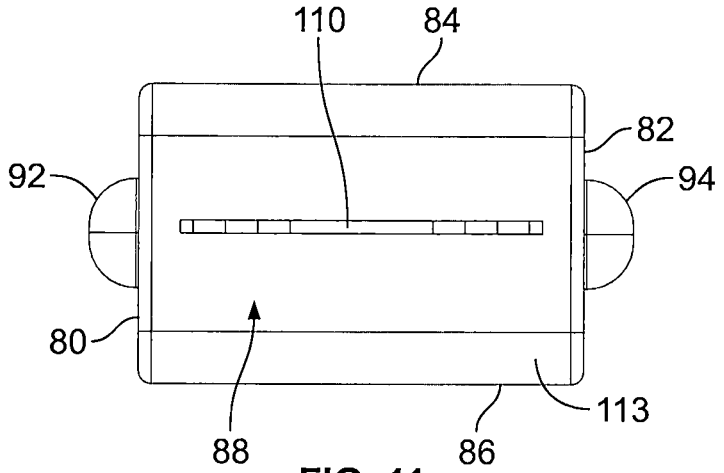
FIG. 11 is a front elevation view of the pivot block shown in FIGS. 10-16.
Figure 12:
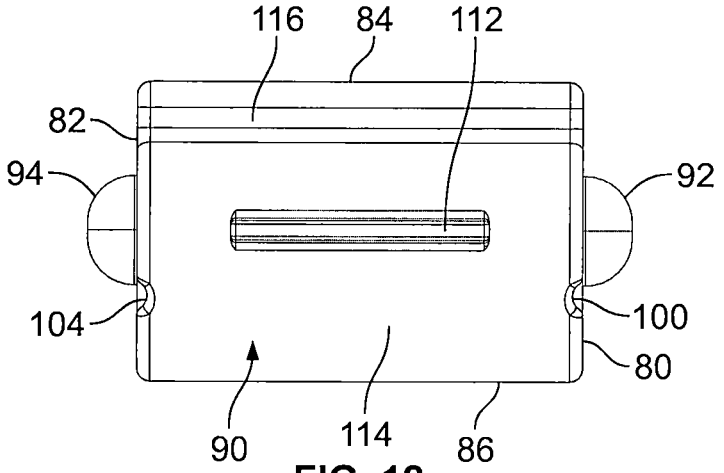
FIG. 12 is a rear elevation view of the pivot block shown in FIGS. 10-16.
Figure 13:
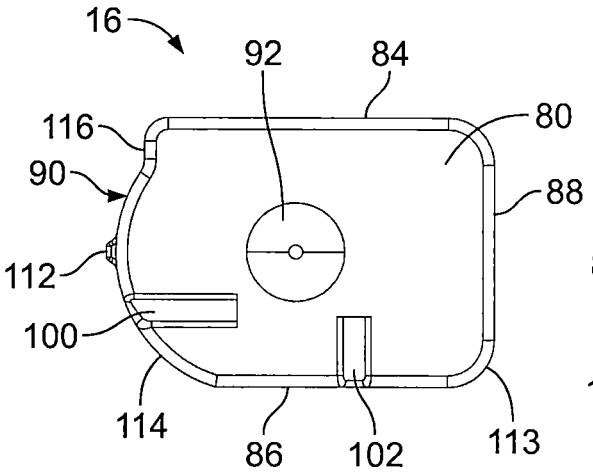
FIG. 13 is a left side elevation view of the pivot block shown in FIGS. 10-16.
Figure 14:
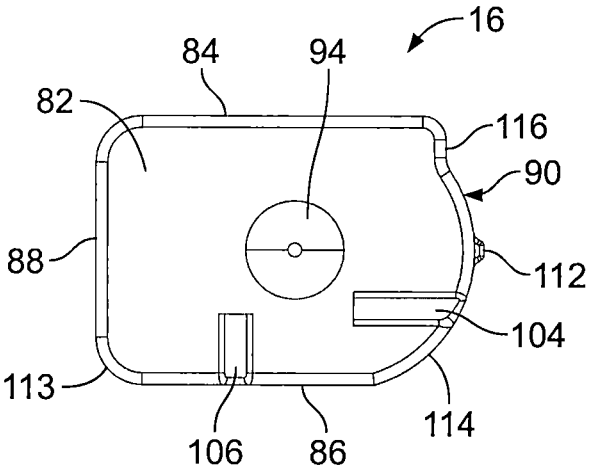
FIG. 14 is a right side elevation view of the pivot block shown in FIGS. 10-16.
Figure 15:
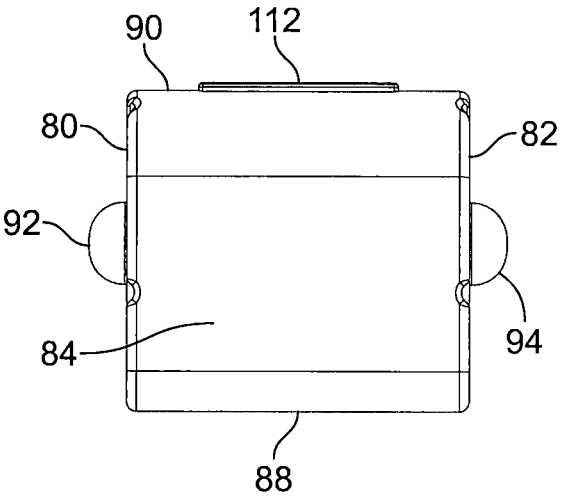
FIG. 15 is a top plan view of the pivot block shown in FIGS. 10-16.
Figure 16:
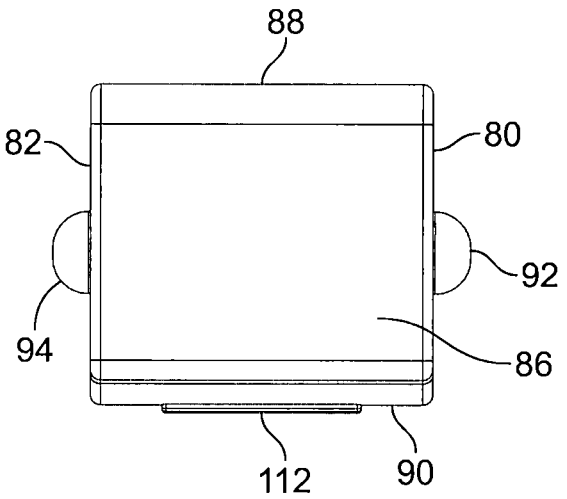
FIG. 16 is a bottom plan view of the pivot block shown in FIGS. 10-16.
Figure 17:
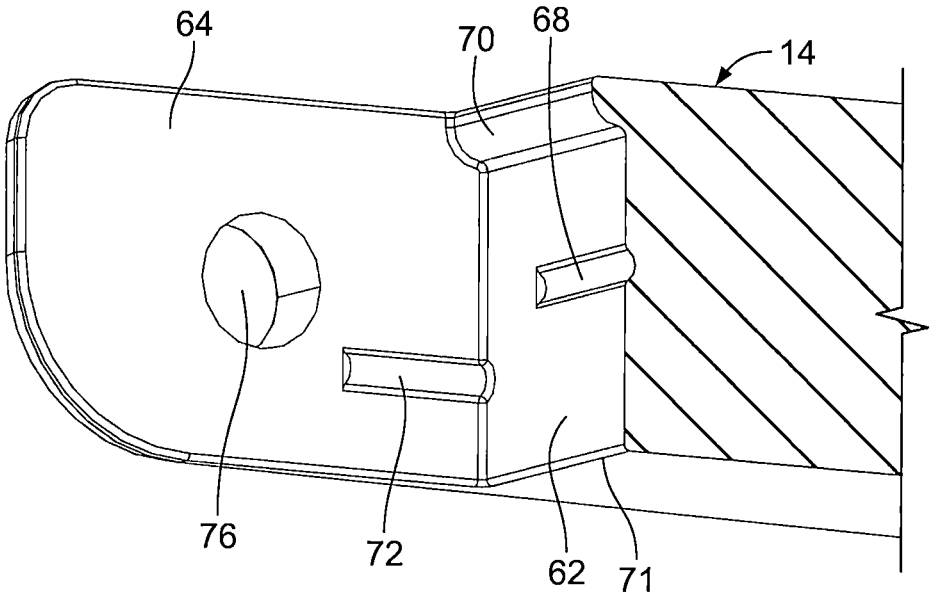
FIG. 17 is an enlarged cross-sectional isometric view of a forward portion of the handle showing detent elements.
Figure 18:
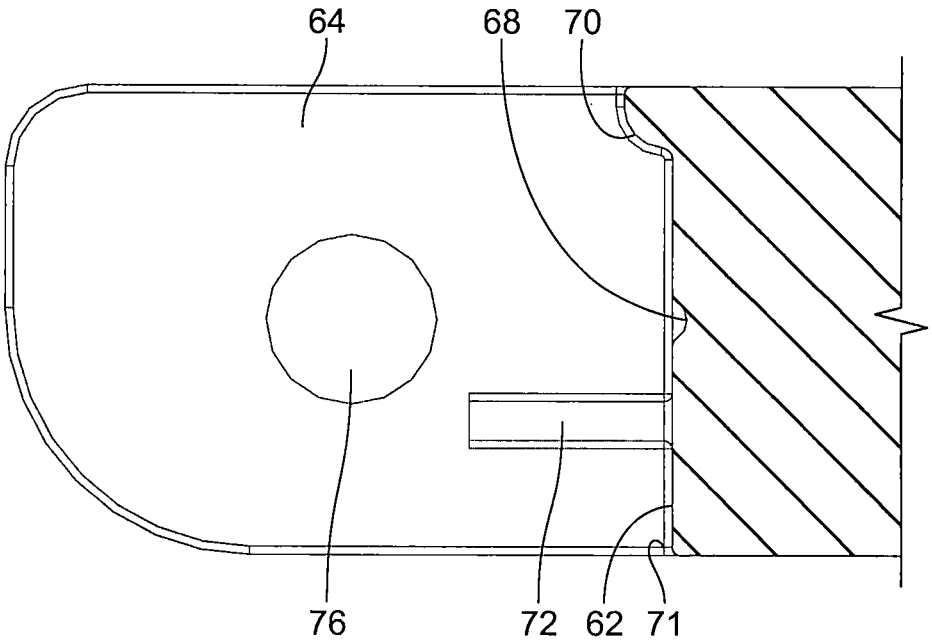
FIG. 18 is a cross-sectional elevation view of the forward portion of the handle shown in FIG. 17.

The handle 14 may have a convenient shape with a grip portion 50, FIGS. 1, 2 and 4, the grip portion 50 having an opening 52 at a rearward end. The grip portion 50 includes a first surface 54, FIG. 1, a second surface 56 and a wrap around sidewall 58. The handle 14 has a longitudinal axis 60, FIG. 1. At a forward end of the handle 14 are a front wall 62, FIGS. 4 and 9, and a pair of forward extending arms 64, 66. The front wall 62 includes movement hindering structure is the form of a two part detent. The first part is a detent element formed as a recess or groove 68, FIGS. 4, 9, 17 and 18, in a generally lateral disposition. The front wall also includes a first movement limiting structure also formed in two parts. The first part is a lateral abutment surface or bump 70 at the top of the front wall 62. The front wall 62 also includes a second movement limiting structure formed in two parts. The first part is an abutment edge surface 71 at the bottom of the front wall that joins the front wall 62 with the second handle surface 56.

The term 'detent' used here means a mechanism or device that temporarily keeps one component or part in a certain relative position to that of another, and can be released by applying force to one of the components or parts. Here, the two components are the pivot block 16 (to which the blade 12 is attached such that the blade and pivot block move together) and the handle 14. The mechanism or device may consist two elements, a protrusion and a mating recess or groove. Also here, the two detent elements, each a protrusion and a mating groove/recess, cooperate to maintain the blade 12 and the handle 14 in one of two positions chosen by a user. For example, the foldable utensil here is designed to have three sets of detents for the pivot block and the handle: two sets to maintain the blade and the handle in an extended configuration where their longitudinal axes 42, 60 are generally parallel to one another as shown in FIGS. 1 and 2, and one set to maintain the blade and handle in a folded or generally right angle configuration where their longitudinal axes 42, 60 are generally perpendicular to one another, as shown in FIG. 3. The resistance or hindrance to movement in these two positions may be overcome by applying a force to either the blade 12 or the handle 14, thereby allowing the blade and the handle to move between the two mentioned configurations for use and for storage, respectively. The detents are identified here as 'movement hindering structures.'

The phrase 'movement limiting structures' used here refers to structures that abut one another to limit or block movement.

The arms 64, 66, FIGS. 4, 8, 9, 17 and 18, of the handle 14 include movement hindering structures formed as generally longitudinally disposed detent elements in the form of protrusions 72, 74. The arms 64, 66 also include openings 76, 78 for receiving the pivot block 16. The handle arms 62, 64 enable the handle 14 to engage and secure the pivot block 16 while enabling the pivot block to rotate so that the blade 12 and the handle 14 may move between the extended and the folded configurations as illustrated in FIGS. 2 and 3, respectively. In the extended configuration the longitudinal axes 42, 60 are generally parallel to one another, and in the folded configuration the longitudinal axes are generally perpendicular to one another. As will be disclosed in detail below, the blade and the handle are generally restricted to move only between these two configurations.

The pivot block 16, FIGS. 10-16, has a generally six-sided configuration having left and right sidewalls 80, 82, a top wall 84, a bottom wall 86, a front wall 88 and a rear wall 90. Each of the sidewalls 80, 82 includes a rounded shaft 92, 94 and first and second movement hindering structures formed as two mutually perpendicular detent elements in the form of grooves, such as the grooves 100, 102, FIG. 13, in the left sidewall 80 and the grooves 104, 106, FIG. 14, in the right sidewall 82. The front wall 88 includes a slit opening 110, FIG. 11, and the rear wall 90 includes a curved lower portion 114, FIGS. 13 and 14. The rear wall 90 also includes a movement hindering structure formed as a lateral protrusion detent element 112, FIG. 12. The front wall 88 also includes a movement limiting structure formed as an abutment corner surface 113, FIGS. 4, 13 and 14, between the front wall 88 and the bottom wall 86. As part of the rear wall 90 there is a movement limiting structure in the form of an abutment surface 116, FIGS. 13 and 14.

The rounded shafts 92, 94 are intended to be received by the openings 76, 78 in handle arms 62, 64, respectively, so that the pivot block 16 is enabled to rotated roughly 90°, between the extended configuration illustrated in FIG. 2, and the folded configuration illustrated in FIG. 3. The first movement hindering structures are a first detent including the first detent element, the protrusions 72, on one side of the handle 14, positioned to mate with the second detent element, the groove 100, on one side of the pivot block 16; the first movement hindering structures also are the first detent including the first detent element, the protrusions 74, on the other side of the handle, positioned to mate with the second detent element, the groove 104, on the other side of the pivot block. The above mentioned detent elements resist movement when the longitudinal axis 42 of the blade 12 is generally parallel with the longitudinal axis 60 of the handle 14, the configuration of the utensil when use is intended, and referred here as the extended configuration. The protrusions 72, 74 and the grooves 100, 104 form a pair of first detents. The second movement hindering structures include the same first detents formed by first detent elements, namely the protrusions 72, 74. However now, the protrusions 72, 74 are positioned to mate with a second detent formed by third and fourth detent elements, namely the grooves 102, 106, respectively. The mating of the protrusion 72 with the groove 102 and the protrusion 76 with the groove 106 comes about when the longitudinal axis 42 of the blade 12 is about perpendicular with the longitudinal axis 60 of the handle 14. This occurs when the utensil is intended to be stored while mounted to a container, and is also known as the folded configuration. The protrusions 72, 74 and the grooves 102, 106 form a pair of second detents.

The front wall 88 of the pivot block 16 includes the slit opening 110 for receiving the tab portion 36 of the blade 12, and enables the blade to be secured to the pivot block so as to rotate with the pivot block as one assembly. The rear wall 90 of the pivot block and the front wall 62 of the handle may include a third movement hindering structures where a third detent may consist of a first detent element, the protrusion 112, FIGS. 8 and 12, of the pivot block, which is located to engage or mate with a second detent element, the groove 68, FIGS. 8 and 9, in the front wall 62 of the handle 14. This occurs when the blade 12 is extended for use, where the longitudinal axes 42, 60 are about parallel to one another.

The curved lower portion 114 of the pivot block rear wall 90 is designed to enable the pivot block 16 to rotate easily relative to the handle 14 when the blade 12 moves relative to the handle 14 between the extended and folded configurations. First movement limiting structures of the utensil 10 consists of an upper portion abutment surface 116 on the pivot block rear wall 90, which is positioned to engage the abutment surface 70 of the handle 14 when the utensil is extended for use. The first movement limiting structures, the abutment surface 116 and the abutment surface 70, prevent or block the blade 12 from moving upward (or rotating clockwise when viewed in FIG. 2) beyond the extended arrangement of the blade and the handle when in use, where the utensil is in its extended configuration. It is noted that the abutment surface blockages are approximate because of component and manufacturing tolerances and wear on the component surfaces. Second movement limiting structures of the utensil consists of another pair of abutment structures to prevent the mountable and foldable utensil 10 from folding much beyond 90°, the position shown in FIG. 3. Referring again to FIG. 4, the pivot block 16 includes the abutment corner surface 113 connecting the front wall 88 and the bottom wall 86, the surface 113 for engaging an abutment edge surface 71 connecting the front wall 62 with the second surface 56 of the handle 14. The result is that when the user rotates the utensil 10 from the extended position to the folded position, further movement of the handle much beyond the folded position is prevented because the surface 113 of the pivot block 16 abuts the edge surface 71 of the handle.

The term 'abutment' here refers to the part of a structure that directly receives thrust or pressure. For example, should a user attempt to bend or rotate the blade 12 upward from the configuration shown in FIGS. 1 and 2, abutment surface 116 will contact the abutment surface 70 to counter such pressure and prevent such movement. Pressure on the blade 12 may also come when a user scoops food product from the tub 18. Once again, the abutment surface 116 will be stopped by the abutment surface 70. The term 'abuts' here refers to movement of a structure that terminates at contact with another structure. In this case, rotation of the surface 113 will terminate movement of the pivot block 16 at contact with the surface 71 of the handle 14.

Figure 19:
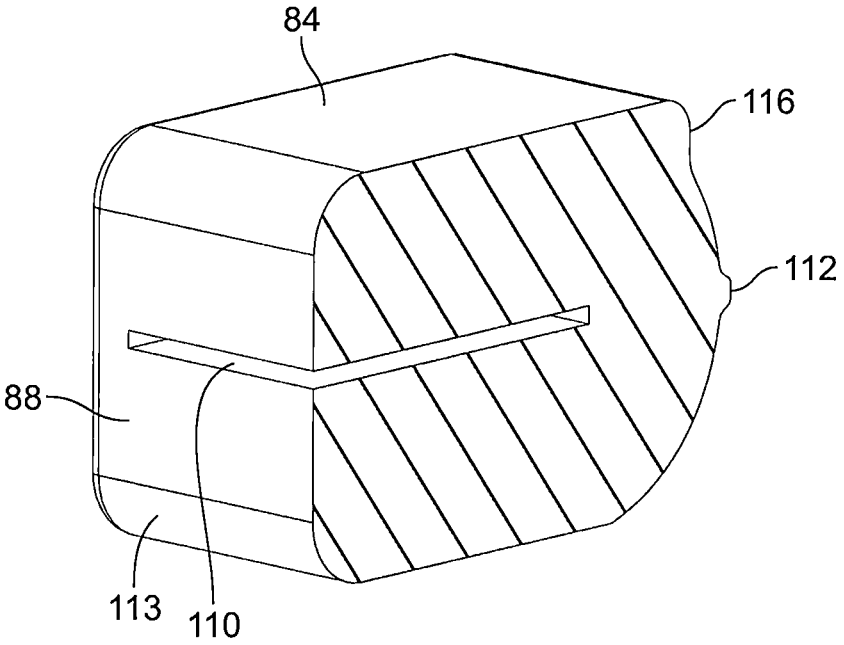
FIG. 19 is an enlarged cross-sectional isometric view of the pivot block showing a slot for receiving the blade.
Figure 20:
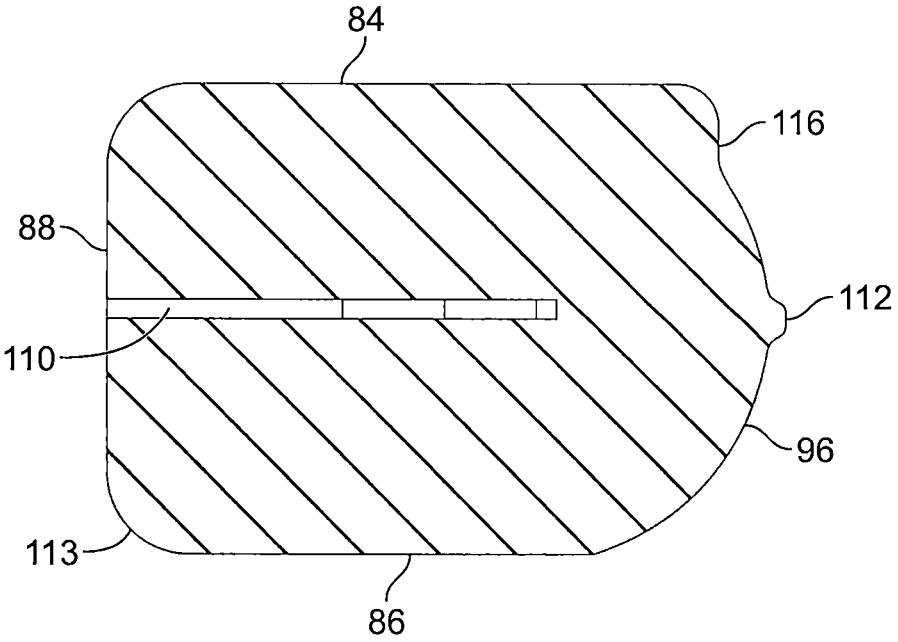
FIG. 20 is a cross-sectional elevation view of the pivot block shown in FIG. 19.
Figure 21:
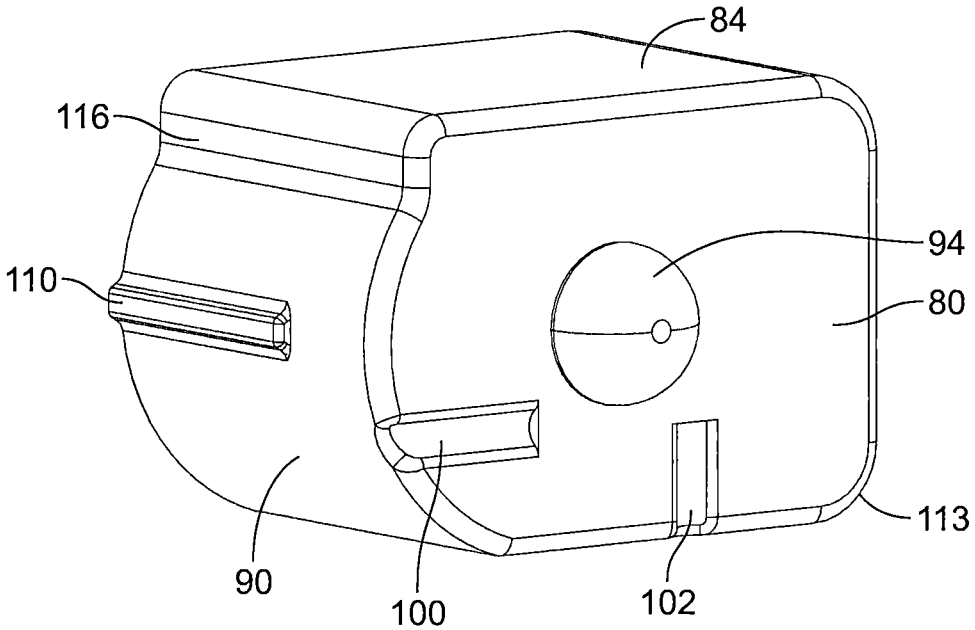
FIG. 21 is an enlarged, partial rear isometric view of the pivot block.
Figure 22:
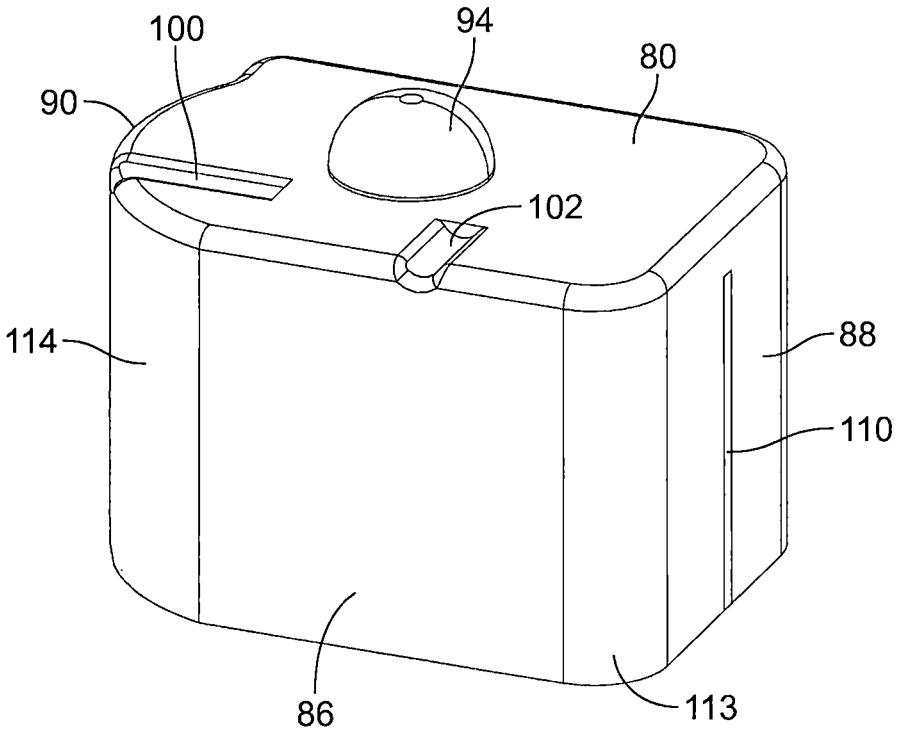
FIG. 22 is an enlarged, partial bottom isometric view of the pivot block.

Referring again to FIGS. 17 and 18, the protrusions and grooves are shown in enlarged detail. At the front wall 62 of the handle 14, the groove 68 is shown more clearly as is the protrusion 72 on the arm 64. In FIGS. 19 and 20, the slit opening 110 in the front wall 88 of the pivot block 16 and the protrusion 112 on the rear wall 90 are also shown enlarged. Likewise, in FIGS. 21 and 22, the grooves 100 and 102 in the pivot block are shown enlarged.

In the alternative, the protrusions and mating grooves may be reversed in some cases, for example, on the front wall 62 of the handle 14, the groove 68 may instead be a protrusion, and on the pivot block 16, the mating protrusion 112 may instead be a groove. Also in the alternative, the detent elements may be mating small mounds and holes or other suitable configurations. In another alternative, other devices, such as pins and holes may be used, if desired.

The blade may be formed of any suitable material, such as stainless steel, plastic, ceramic, silicone or stainless steel with a ceramic coating. For example, 304 grade stainless steel, 18/8 or 18/10 (percent of chromium and nickel) may be used. The handle may also be made of any suitable material, such as a polypropylene or polystyrene or a suitable composite. The blade may have a length of about 65 mm and be about 1 mm thick (between the surfaces 32 and 34, FIG. 2), and the loop 40 may be about 2 mm wide as labeled 117, FIG. 2. The material of the blade must be strong enough to scoop food product and yet thin enough to allow the lid 22 to be fastened to the tub 18 when stored. The distance 118, FIG. 2, of the tab portion 36 of the blade 12 between the loop 40 and the front surface 88 of the pivot block 16 may be about 1 mm. This distance is to be kept to a minimum so as to minimize the space taken up by the folded spreader 10 and the tub 18 to which the spreader is mounted. It is noted that when folded, the pivot block adds about 3 mm, 119, FIG. 3, to the total distance between the handle 14 and the side of the tub 18. The handle 14 may have a length of about 67 mm so as to not interfere with a flat bottom surface of a tub. Typically, the tub height is about 70 mm. In the alternative, the handle may be scaled up or down. The arms 64, 66 of the handle may extend about 15 mm.

The pivot block may be about 15.5 mm between the front wall 88 and the extent of the protrusion 112 on the rear wall 90, about 18 mm between the sidewall 80 and the sidewall 82, and about 12 mm between the top wall 84 and the bottom wall 86.

Figure 23:
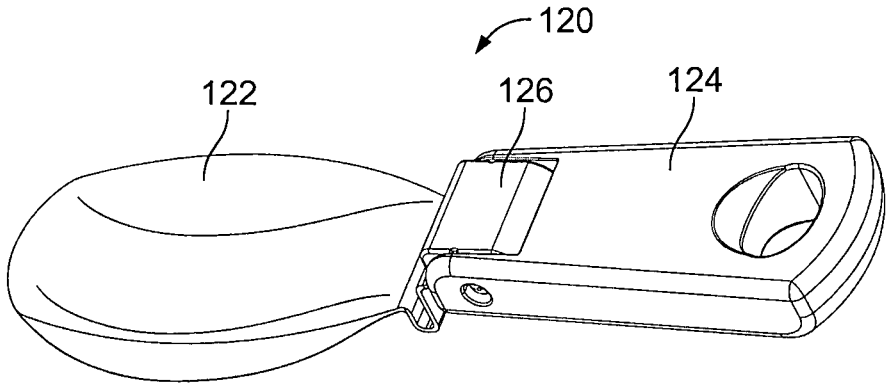
FIG. 23 is an isometric view of a spoon embodiment of the foldable utensil.
Figure 24:
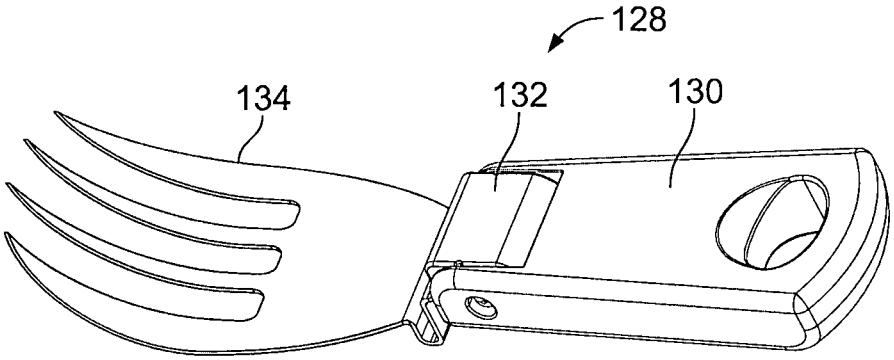
FIG. 24 is an isometric view of a fork embodiment of the foldable utensil.
Figure 25:
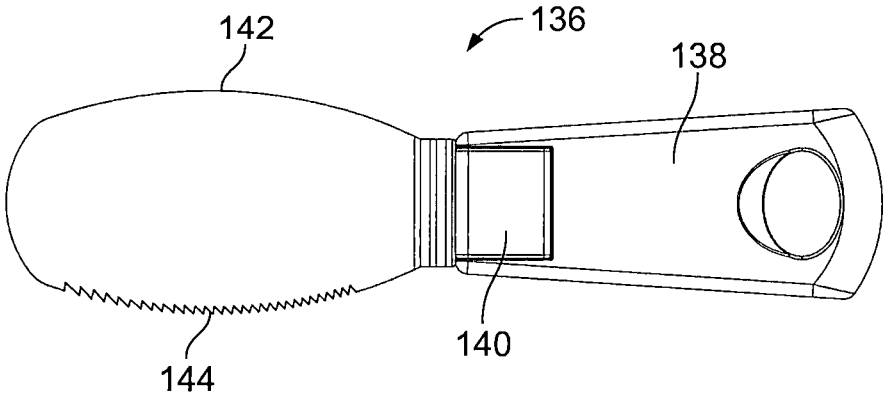
FIG. 25 is a top plan view of a spreader embodiment of the foldable utensil having a serrated edge.

Other embodiments of the foldable utensil may now be considered. For example, the instrument of a mountable and foldable utensil 120, FIG. 23, instead of being a spreader blade, may take the form of a spoon 122 having the usual concave design. The mountable foldable utensil 120 includes a handle 124 and a pivot block 126 that may be identical to the handle 14 and pivot block 16, respectively, disclosed in detail above. A fork embodiment is shown in FIG. 24 where a foldable utensil 128 includes a handle 130, a pivot block 132 (identical to the handle 14 and the pivot block 16) and an instrument in the form of a fork 134. Yet another embodiment is shown in FIG. 25, where a mountable foldable utensil 136 includes the same handle 138, and pivot block 140, and an instrument in the form of a spreader blade 142 with a serrated edge 144.

In operation, the foldable utensil with detents operates in one of two positions or configurations. When in use as a spreader, the blade 12 is extended relative to the handle 14 such that the longitudinal axis 42 of the spreader blade is generally parallel to the longitudinal axis 60 of the handle. A first set of detent elements maintains the utensil in its extended configuration (and the engagement of abutment surfaces prevents the spreader from folding upward). In use, the spreader is handled such that any pressure, such as when the user is scooping butter from a tub, is applied to the bottom surface 34 of the spreader portion 30 of the blade 12. In this fashion, the blade will not fold because the abutment surface 116 will bear against the abutment surface 70. After use, the user may mount the spreader 10 to the rim 20 of the tub 18 and easily fold the handle downward for convenient storage. When folded, the longitudinal axis 60 of the handle 14 is approximately or roughly perpendicular to the longitudinal axis 42 of the spreader blade 12. A second set of detent elements maintains the spreader 10 in its folded configuration. In both the extended and the folded positions, the detents are positioned on the handle 14 and on the pivot block 16 to resist movement away from the position selected by the user, namely, the extended or the folded position; however, with a slight force provided by the user, the foldable utensil may easily be moved from one position to the other position. When the user desires to again use the spreader, the lid 22 of the tub 18 is removed and the spreader may be extended and dismounted from the tub (or the spreader may be dismounted and then extended).

It is noted that throughout this detailed description, words such as "front" and "rear," "forward" and "rearward," and "up" and "down," as well as similar positional or locational terms, refer to portions or elements of the utensil apparatus as they are viewed in the drawings relative to other portions, or in relationship to the positions of the apparatus as it will typically be held and moved by a user, or to movements of elements based on the configurations illustrated. Terms such as "generally" means "about" or "approximately."

Figure 26:
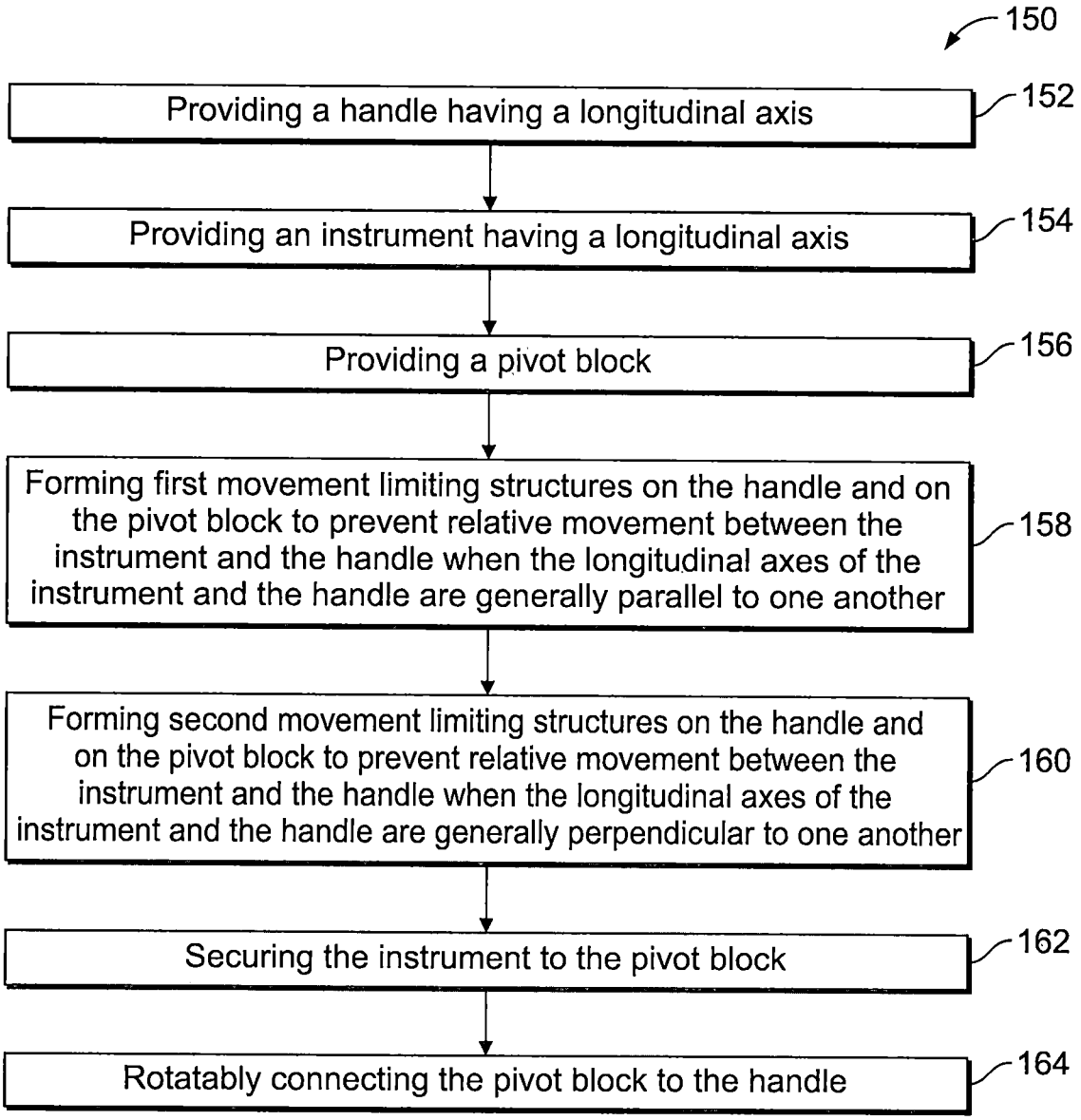
FIG. 26 is a flow diagram of a method for assembling a foldable utensil.

The present invention also includes a method 150, FIG. 26, for assembling a mountable and foldable utensil, including the steps of providing a handle having a longitudinal axis 152, providing an instrument having a longitudinal axis 154, providing a pivot block 156, forming first movement limiting structures on the handle and the pivot block to prevent relative movement between the instrument and the handle when the longitudinal axes of the instrument and the handle are generally parallel to one another 158, forming second movement limiting structures on the handle and the pivot block to prevent relative movement between the instrument and the handle when the longitudinal axes of the instrument and the handle are generally perpendicular to one another 160, securing the instrument to the pivot block 162, and rotatably connecting the pivot block to the handle 164.

The mountable foldable utensil with detents disclosed in detail above is easy to use, is simple in structure and yet is robust, and may be produced at a reasonable cost. The mountable foldable utensil saves time in handling the apparatus and may be efficiently stored.

From the foregoing, it can be seen that there has been provided features and advantages for an improved mountable and foldable utensil and a disclosure of a method for assembling the mountable and foldable utensil. While particular embodiments and variations of the present invention have been shown and/or described in great detail, it will be obvious to those skilled in the art that changes and modifications may be made without departing from the invention in its broader aspects. Therefore, the aim is to cover all such changes and modifications as fall within the true spirit and scope of the invention as defined in corresponding allowable claims. The matters set forth in the foregoing description and accompanying drawings are offered by way of illustrations only and not as limitations. Again, the actual scope of the invention is to be defined by corresponding allowable claims.

What is claimed is:

1. A mountable and foldable utensil comprising:

a handle to enable a user to hold the utensil, the handle having a longitudinal axis, and includes two arms;

an instrument having a utility portion, a mounting portion, and a tab portion, the instrument having a longitudinal axis;

a pivot block rotatably connected to the handle and secured to the tab portion of the instrument, the pivot block includes two shafts, and each arm of the two arms includes an opening to receive one of the shafts of the pivot block;

first movement limiting structures connected to the pivot block and to the handle to limit rotational movement of the instrument relative to the handle when the longitudinal axes of the instrument and of the handle are generally parallel; and first movement hindering structures connected to the pivot block and to the handle to hinder rotational movement of the instrument relative to the handle when the longitudinal axes of the instrument and of the handle are generally parallel.

2. The mountable and foldable utensil of claim 1 wherein:

the pivot block includes a distal end to which the tab portion is secured and a proximal end opposite the distal end, and the first movement limiting structures include a pivot block abutment surface on the pivot block extending generally lateral to the longitudinal axis of the instrument, the pivot block abutment surface is disposed on the proximal end of the pivot block, and a handle abutment surface on the handle extending generally lateral to the longitudinal axis of the instrument.

3. The mountable and foldable utensil of claim 1 wherein:

the first movement hindering structures include a first detent element on the pivot block and a corresponding first handle detent element on the handle.

4. The mountable and foldable utensil of claim 3 wherein:

the first movement hindering structures include a second detent element on the pivot block and a corresponding second handle detent element on the handle, the first detent element and the second detent element positioned generally parallel to the longitudinal axis of the instrument, and the first handle detent element and second handle detent element on the handle generally parallel to the longitudinal axis of the handle.

5. The mountable and foldable utensil of claim 3 wherein:

the first movement hindering structures include a second detent element on the pivot block and a corresponding detent element on the handle, the first detent element and second detent element are generally parallel to the longitudinal axis of the instrument, and the corresponding detent elements on the handle generally parallel to the longitudinal axis of the handle; and the first handle detent element and second handle detent element include protrusions, and the detent element and second detent element on the pivot block include mating recesses.

6. The mountable and foldable utensil of claim 2 wherein:

the handle includes a forward wall and the two arms are forward extending arms; and the pivot block is mounted on the extending arms.

7. The mountable and foldable utensil of claim 6 wherein:

the first movement hindering structures include an elongate handle detent element positioned on the forward wall of the handle, the elongate handle detent element extending generally lateral to the longitudinal axis of the handle, and a corresponding elongate pivot block detent element positioned on the proximal end of the pivot block, the elongate pivot detent element extending generally lateral to the longitudinal axis of the instrument.

8. A method for assembling a mountable and foldable utensil, comprising the steps of:

providing a handle having a longitudinal axis;

providing an instrument having a longitudinal axis;

providing a pivot block;

forming a forward wall and two forward extending arms on the handle;

forming first movement limiting structures on the handle and on the pivot block to prevent relative movement around a rotational axis between the instrument and the handle when the longitudinal axes of the instrument and the handle are generally parallel to one another;

forming first movement hindering structures on the pivot block and the handle to hinder relative movement around the rotational axis between the instrument and the handle when the longitudinal axes of the instrument and the handle are generally parallel to one another;

securing the instrument to the pivot block; and rotatably connecting the pivot block to the handle on the extending arms.

9. The method of claim 8, wherein the step of forming the first movement hindering structures includes the steps of:

forming, on a proximal end of the pivot block, a pivot block abutment surface on the pivot block extending generally lateral to the longitudinal axis of the instrument; and forming, on the forward wall of the handle, a handle abutment surface on the handle extending generally lateral to the longitudinal axis of the handle; and wherein the step of securing the instrument to the pivot block includes the step of:

securing a tab of the instrument to a distal end of the pivot block opposite the proximal end of the pivot block.

10. The method of claim 8, including the steps of:

forming an elongate handle detent element on the forward wall of the handle, such that the elongate handle detent element extends generally lateral to the longitudinal axis of the handle; and forming a corresponding elongate pivot detent element on a proximal end of the pivot block, such that the elongate pivot detent element extends generally lateral to the longitudinal axis of the instrument when the instrument is secured to a distal end of the pivot block that is opposite the proximal end of the pivot block.

11. The mountable and foldable utensil of claim 1 wherein:

the utility portion includes a first surface and a second surface, the utility portion having a length along the longitudinal axis of the instrument, a width along a lateral axis that is perpendicular to the longitudinal axis and that is shorter than the length, and a thickness between the first surface and the second surface and that is shorter than the width, and the mounting portion having a thickness that is the same as the thickness of the utility portion.

12. The mountable and foldable utensil of claim 1, wherein:

the pivot block includes a proximal end, a distal end to which the tab portion is secured, a first side extending between the proximal end and the distal end, and a second side extending between the proximal end and the distal end on an opposite side of the pivot block from the first side, the pivot block is connected to the handle via the first side and the second side such that the pivot block is configured to rotate around a lateral axis that extends between the first side and the second side.

13. The mountable and foldable utensil of claim 12, wherein:

the first movement limiting structures limit rotational movement of the instrument relative to the handle in a first direction and permits rotational movement of the instrument relative to the handle in a second direction opposite the first direction when the longitudinal axes of the instrument and of the handle are generally parallel.

14. The mountable and foldable utensil of claim 2, wherein:

physical contact between the pivot block abutment surface and the handle abutment surface limit rotational movement of the instrument in a first direction relative to the handle when the longitudinal axes of the instrument and of the handle are generally parallel, and rotational movement of the instrument in a second direction opposite the first direction causes the pivot block abutment surface to rotate away from the handle abutment surface.

15. The mountable and foldable utensil of claim 14, wherein:

the utility portion includes a first instrument surface and a second instrument surface, the handle includes a first handle surface and a second handle surface, a thickness of the utility portion between the first instrument surface and the second instrument surface being shorter than a thickness of the handle between the first handle surface and the second handle surface, a first angle between the first instrument surface and the first handle surface and a second angle between the second instrument surface and the second handle surface are substantially equal when the longitudinal axes of the instrument and of the handle are generally parallel, and rotational movement of the instrument in the second direction causes the first angle to increase and the second angle to decrease.

16. A mountable and foldable utensil comprising:

a handle having a longitudinal axis, the handle comprising:

a first movement limiting structure;

an instrument having a longitudinal axis, the instrument comprising:

a utility portion;

a tab portion;

a curved mounting portion disposed between the utility portion and the tab portion along the longitudinal axis of the instrument, wherein the curved mounting portion has a concave surface and a convex surface, and wherein a first portion of the concave surface closer to the tab portion is parallel to a second portion of the concave surface that is closer to the utility portion, thereby forming a gap between the first portion and the second portion of the concave surface, such that when the mountable and foldable utensil is mounted, via the curved mounting portion, on a rim of a condiment container having a side wall with a thickness that is shorter than a width of the gap, the first portion is disposed on a first side of the side wall and the second portion is disposed on a second side of the side wall; and a pivot block having a first axis that is generally parallel to the longitudinal axis of the instrument, and a second axis that is generally perpendicular to the longitudinal axis of the instrument and generally parallel to a longitudinal axis of the gap, wherein the pivot block is connected to the tab portion and rotatably connected to the handle, which enables the instrument and the handle to rotate about the second axis of the pivot block from a use position where the longitudinal axes of the handle and instrument are generally parallel to each other to a storage position where the longitudinal axes of the handle and the instrument are generally perpendicular to each other, and wherein the pivot block comprises:

a second movement limiting structure disposed to abut the first movement limiting structure in the use position, thereby permitting rotation about the second axis in a first direction toward the storage position, and limiting rotation around the second axis in an opposite direction past the use position.

17. The mountable and foldable utensil of claim 16, wherein the pivot block comprises:

a distal end closer to the tab portion; and a proximal end opposite the distal end, the proximal end comprising the second movement limiting structure.

18. The mountable and foldable utensil of claim 17, wherein the handle comprises an elongate handle detent element on the proximate end, the elongate handle detent element extending generally lateral to the longitudinal axis of the handle; and wherein the pivot block comprises a corresponding elongate pivot block detent element extending generally lateral to the longitudinal axis of the instrument, and positioned such that in the use position the elongate handle detent element and the elongate pivot block detent element engage to hinder movement toward the storage position.

* * * * *